US011261677B2

(12) United States Patent
Hellman

(10) Patent No.: US 11,261,677 B2
(45) Date of Patent: Mar. 1, 2022

(54) SYSTEM FOR DRILL BIT CHANGE IN A DRILLING RIG, DRILLING RIG COMPRISING SUCH A SYSTEM, AND A METHOD FOR CHANGING DRILL BITS USING SUCH A SYSTEM

(71) Applicant: EPIROC ROCK DRILLS AKTIEBOLAG, Örebro (SE)

(72) Inventor: Anders Hellman, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 17/057,288

(22) PCT Filed: May 16, 2019

(86) PCT No.: PCT/SE2019/050443
§ 371 (c)(1),
(2) Date: Nov. 20, 2020

(87) PCT Pub. No.: WO2019/226096
PCT Pub. Date: Nov. 28, 2019

(65) Prior Publication Data

US 2021/0198957 A1 Jul. 1, 2021

(30) Foreign Application Priority Data

May 21, 2018 (SE) ..... 1850598-2

(51) Int. Cl.
*E21B 19/18* (2006.01)
*E21B 19/14* (2006.01)
*E21B 19/20* (2006.01)

(52) U.S. Cl.
CPC ..... *E21B 19/146* (2013.01); *E21B 19/18* (2013.01); *E21B 19/20* (2013.01)

(58) Field of Classification Search
CPC ..... E21B 19/146; E21B 19/20; E21B 19/18
See application file for complete search history.

(56) References Cited

U.S. PATENT DOCUMENTS 3,977,480 A 8/1976 Hilding
3,986,569 A 10/1976 Hilding et al.
(Continued)

FOREIGN PATENT DOCUMENTS

KR 101691076 B1 12/2016
WO 2009156574 A1 12/2009
WO 2016116148 A1 7/2016

OTHER PUBLICATIONS

International Search Report and Written Opinion in corresponding International Application No. PCT/SE2019/050443 dated Jun. 24, 2019 (10 pages).

*Primary Examiner* — Kipp C Wallace
(74) *Attorney, Agent, or Firm* — Jeffri A. Kaminski; Venable LLP

(57) ABSTRACT

A drilling rig includes an interchangeable plurality of drill pipes, wherein drill bits are arranged at an end section of an end drill pipe. The drill bit being attached to the end section by means of a threaded connection and torque being provided to the drill bit by means of a splines coupling. The drilling rig comprises a lower support device and a breaker device. The system includes a drill bit storage device arranged to hold a plurality of drill bits, a gripping arm for selective gripping of a drill bit. The gripping arm may further comprise a movement sensor, arranged to monitor movement of the gripping arm, and the system may further comprise a control unit. The control unit being arranged to receive input from the sensors and the drilling rig, and to control movement of the gripping arm, the gripping means, the drill bit storage device, and the breaker device of the drilling rig.

14 Claims, 6 Drawing Sheets

(56) References Cited

U.S. PATENT DOCUMENTS

| | | | | |
|---|---|---|---|---|
| 6,591,471 | B1 * | 7/2003 | Hollingsworth | E21B 19/16 166/85.1 |
| 2001/0020550 | A1 * | 9/2001 | Casagrande | E21B 19/146 175/52 |
| 2006/0162963 | A1 * | 7/2006 | Hagemeyer | E21B 19/146 175/52 |
| 2007/0209838 | A1 * | 9/2007 | Kraus | E21B 19/146 175/52 |
| 2010/0108388 | A1 * | 5/2010 | Pires | E21B 19/146 175/52 |
| 2010/0200297 | A1 * | 8/2010 | Comacchio | E21B 19/146 175/52 |
| 2014/0083765 | A1 | 3/2014 | Hoult et al. | |
| 2014/0083774 | A1 | 3/2014 | Hoult et al. | |
| 2014/0186143 | A1 * | 7/2014 | Owens | E21B 19/146 414/22.66 |
| 2014/0338973 | A1 * | 11/2014 | Taylor | E21B 19/20 175/24 |
| 2017/0234087 | A1 * | 8/2017 | Gaska | E21B 15/00 175/85 |

* cited by examiner

SYSTEM FOR DRILL BIT CHANGE IN A DRILLING RIG, DRILLING RIG COMPRISING SUCH A SYSTEM, AND A METHOD FOR CHANGING DRILL BITS USING SUCH A SYSTEM

CROSS-REFERENCE TO RELATED APPLICATIONS

This application is a U.S. National Stage application of PCT/SE2019/050443, filed May 16, 2019 and published on Nov. 28, 2019 as WO 2019/226096, which claims the benefit of Swedish Patent Application No. 1850598-2 filed May 21, 2018, all of which are hereby incorporated by reference in their entireties.

TECHNICAL FIELD

The present disclosure relates to a system for drill bit change in a drilling rig, a drilling rig comprising such a system, and a method for changing drill bits using such a system. The present disclosure further relates to software performing such a method when being executed.

BACKGROUND ART

When performing drilling operations in rock-type materials generally special kinds of drilling rigs are used. There are different types of such drilling rig, wherein "DTH" (down the hole)-drilling rigs and top hammer drilling rigs are two commonly used rigs for such operations being performed in a vertical, or close to vertical, direction. As rock drilling is performed in hard materials special kinds of drill bits are used for such operations. Such drill bits are often heavy and may get oily and dirty when used, and may also after usage comprise sharp edges and/or chips of material which may cause harm to a person when handling such a drill bit. The drill bits will however require maintenance in the form of replacement and/or re-grinding, which in turn leads to a need to remove and attach such drill bits to the drilling rig every now and then. Due to the above described properties and circumstances surrounding handling of drill bits, such removing and attaching operations are heavy, inconvenient and at times the cause of personal injury.

To alleviate such issues drill bit change systems are used, which systems may provide a fully or semi-automatic replacement process for drilling rigs. DTH drilling rigs generally comprise a spline coupling for attaching a drill bit to such a drilling rig, whereas top hammer drilling rigs in general instead utilize a threaded connection. Therefore such drill bit changing systems are designed differently for those two types of drilling rigs.

However, there are also additional types of drilling rigs, which utilize both a threaded connection and a spline connection between the drilling rig and drill bit. Such connections are more complex as there are more interacting parts which need to be handled during a drill bit change operation, and prior art systems are not equipped to handle such drilling rigs having such different kind of connection types for fastening of the drill bit.

There is thus a need for an improved drill bit change system which may handle such specially designed drill bit connections, and which may be able to function at least semi-automatically to alleviate hard labour and the risk of personal injury for drill bit operations for such drilling rigs.

SUMMARY OF THE INVENTION

Despite prior art there is thus a need to develop an improved drill bit change system, which may perform drill bit change operations to a drilling rig at least semi-automatically. There is also a need to develop a drilling rig comprising such a system, a method for performing a drill bit changing operation for such a system, and software for executing such a method.

An object of the invention is thus to provide an improved drill bit change system, which may perform drill bit change operations to a drilling rig at least semi-automatically. Additional objects are respectively to provide a drilling rig comprising such a system, a method for performing a drill bit changing operation for such a system, and software for executing such a method.

According to a first aspect, a drill bit change system for at least semi-automatic changing of drill bits in a drilling rig is provided. The drilling rig being configured for vertical, or close to vertical, drilling. The drilling rig may comprise an interchangeable plurality of drill pipes, wherein drill bits are arranged at an end section of an end drill pipe. The drill bit may be attached to the end section by means of a threaded connection and torque may be provided to the drill bit by means of a splines coupling. The drilling rig may further comprise a lower support device and a breaker device, configured for loosening threaded connections of the drill pipes. The system may comprise a drill bit storage device, arranged adjacent and parallel with a drill centre of the drilling rig and being arranged to hold a plurality of drill bits. The drill bit storage device may further be arranged to move drill bits between storage positions and an exchange position comprised therein. The storage positions may be arranged for storing drill bits and the exchange position may be arranged for moving drill bits to and from the drill bit storage device. The system may further comprise a gripping arm comprising gripping means configured for selective gripping of a drill bit. The gripping arm may be arranged to move the gripping means between the exchange position and a drill centre of the drilling rig. The gripping arm may further comprise a movement sensor, arranged to monitor movement of the gripping arm. The system may further comprise a control unit, arranged to receive input from the sensors and the drilling rig, and to control movement of the gripping arm, the gripping means, the drill bit storage device, and the breaker device of the drilling rig.

This has the advantage that a drill bit change system having several beneficial features is provided. The positioning of the drill bit storage device provides a short distance for moving bits to and from the drilling centre of the drilling rig, which results in fast and efficient drill bit changing operations. The internal movement of drill bits within the drill bit storage device further provides a simple and time saving device, wherein the gripping arm only needs to move back and forth between two positions which makes the drill bit changing operations fast and efficient. The gripping means and the gripping arm provides a safe manner of handling the drill bits wherein the drill bits, which may be heavy, sharp and/or non-comfortable to hold and carry, may be completely handled by means of the system. The plurality of sensors provides a reliable monitoring of the system and its parts, wherein the control unit provides means of both operating the parts of the system and interacting with the drilling rig. By means of utilizing the breaker device of the drilling rig, which breaker device in general is an existing device of such a drilling rig as the system is intended for, the system may be more compact and cheaper to manufacture.

According to an aspect, the drill bit storage device further comprises at least one drill bit sensor, arranged to monitor drill bits located in the positions of the drill bit storage device.

This has the advantage that the system will be provided with information regarding not only a present drilling operation but also for drilling operations to be performed at a later point in time. As the drill bit storage device may hold a plurality of drill bits, an operator may in a fast and easy manner monitor how many drill bits are present in the device, wherein planning of drilling operations becomes faster and more efficient.

According to an aspect, the control unit is configured to initiate the at least semi-automatic changing based on operational data of the drilling rig and the drill bit connected to the drilling rig.

This has the advantage that a drill bit changing operation may be initiated automatically between drilling operations if a need for such an operating is detected based on the operational data. The operational data may be data comprising any one or a combination of: time spent drilling, time spent drilling since last maintenance, expected time left until change is needed, meters drilled, meters drilled since last maintenance, or other. The system may thus initiate a drill bit changing operation if the current state of a drill bit is deemed as not in shape for drilling in an upcoming drilling operation. This is beneficial as performing a plurality of drilling operations after each other may be performed in a fast and efficient manner.

According to an aspect, the control unit is further arranged to determine an operational condition of a drill bit based on its operational data, and to provide a user interface with a signal when drill bit change is needed.

This has the advantage that the system may assist in a continuous monitoring of a plurality of drill bits, which may be utilized so as to maximize the usage of each drill bit in the system. The control unit may estimate an operational state of a drill bit based on ingoing operational data coupled with further usage of said drill bit when used for drilling in drilling operation. The operational condition may thus be determined and provided to an operator prior to the need of a upcoming drill bit change operation, which increases the efficiency of the system.

According to an aspect, the drill bit storage device may comprise an enclosing protective housing. The housing may comprise at least a first door arranged at the exchange position, the first door may be arranged to be selectively opened and closed depending on a drill bit exchange operation being performed.

This has the advantage that the drill bits being stored within the drill bit storage device are protected from dust, dirt, oil or debris or similar, which may be common at a drilling site. The stored drill bits being protected in such a manner increases the longevity of said drill bits and ensures that a drill bit is in good shape and condition when it is drawn from the drill bit storage device to be used in a drilling operation.

According to an aspect, the first door of the housing may be coupled to the gripping arm, wherein the first door automatically opens and closes depending on the movement of the gripping arm.

This has the advantage that the operation of the first door is simplified as it may be performed completely automatically coupled with the gripping arm. As the first door in general only should be open when a drill bit changing operation is being performed, the opening and closing of said first door may thus in a reliable and efficient manner be synchronized and controlled by the movement of the griping arm during its movement during such an operation.

According to an aspect, the system may further comprise a lower support plate, which is arranged below the gripping means and may be arranged to be movable in accordance with the gripping means so as to support a drill bit from underneath when held by the gripping means.

This has the advantage that the system may be used for drill bit change operations for wider range of drill bits having different designs. As the type and design of drill bit may vary depending on the type of drilling rig, the gripping means may not be able to hold the drill bit without additional lower support, which may thus be provided by the lower support plate. By means of such a synchronized movement of the gripping means and the support plate, the system may thus increase its usage and be used for various types of drilling rigs.

According to an aspect, the breaker device of the drilling rig may comprise two hydraulically controlled gripping devices. The two gripping devices may be arranged circumferentially around, and at separate positions along, the drill centre. The two gripping devices may further be arranged to grip a part (such as a drill pipe, a drill bit, a drill bit package or other) of the drilling rig and being hydraulically coupled so as to be radially displaceable relative each other. The two gripping devices may thus grip and rotate two separate parts of the drilling rig relative each other so as to open a threaded coupling arranged between said two parts.

This has the advantage that a very robust and reliable breaker device is provided. The hydraulics of the breaker device ensures that large forces may be applied to both sides of a threaded coupling to be opened. Such a breaker device may thus beneficially be utilized by the system so as to open threaded couplings between drill pipes and drill bits/drill bit packages.

According to an aspect, a drilling rig configured for vertical drilling is provided. The drilling rig may comprise an interchangeable plurality of drill pipes, wherein drill bits may be arranged at an end section of an end drill pipe. The drill bit may be attached to the end section by means of a threaded connection and torque may be provided to the drill bit by means of a splines coupling. The drilling rig may further comprise a lower support device and a breaker device, configured for loosening a threaded connections of the drill pipes. The drilling rig may further comprise a system for at least semi-automatic changing of drill bits according to the disclosure.

This has the advantage that a drilling rig having a drill bit change system, which may perform drill bit operations at least semi-automatically is provided. This in turn alleviates hard labour and the risk of personal injury, which provides efficient and safe to use drilling rig.

According to an aspect, the drilling rig is a Coprod™ drilling rig.

This has the advantage that a Coprod™ drilling rig, which is known to be an excellent and reliable drilling rig for vertical drilling, may be provided with a drill bit change system for at least semi-automatic changing of drill bits. This provides the good quality of drilling of the Coprod™ drilling rig with a reliable and safe system for changing the drill bits of said drilling rig. An efficient and reliable drilling rig is thus provided, which by means of the system arranged thereto provides a safe and convenient work environment due to not having the need to change drill bits manually.

According to an aspect, the drilling rig is a DTH/ITH drilling rig.

This has the advantage that a commonly used drilling rig may be provided having the drill bit change system for at least semi-automatic changing of drill bits according to the disclosure. The commonly used DTH/ITH drilling rigs may thus be provided with a reliable and safe system for changing the drill bits of said drilling rig. An efficient and reliable drilling rig is thus provided, which by means of the system arranged thereto provides a safe and convenient work environment due to not having the need to change drill bits manually.

A further advantage may also be realized herein. As the drill bit change system for at least semi-automatic changing of drill bits according to the disclosure may be used for both a Coprod™ and a DTH/ITH drilling rig, the drill bit change system may be utilized for increased cost effectiveness. As the system may function with both said drilling rigs, a company or similar using both said drilling rigs may only need to manufacture or buy one type of drill bit change system which may lower costs for said company.

According to an aspect, a method for changing a drill bit in a drilling rig configured for vertical drilling is provided. The drilling rig may comprise an interchangeable plurality of drill pipes, wherein drill bits may be arranged at an end section of an end drill pipe. The drill bit may be attached to the end section by means of a threaded connection wherein torque may be provided to the drill bit by means of a splines coupling. The drilling rig may further comprise a lower drill bit support and a breaker device, configured for loosening a threaded connections of the drill pipes. The drilling rig may further comprise a system for at least semi-automatic changing of drill bits according to the disclosure. The method may comprise the steps of: a) breaking the threaded connection holding the drill bit coupled to an end drill pipe by means of the breaker device, b) removing the drill bit from the drill pipe by means of the lower support device, c) moving the drill bit from the drill centre to the drill bit storage device by means of the gripping arm, d) retrieving a new drill bit from the drill bit storage device and moving it to the drill centre, e) inserting the new drill bit into the drill pipe, and f) engaging and securing the threaded connection holding the new drill bit coupled to the end drill pipe.

This has the advantage that a fast and efficient method for at least semi-automatic changing of drill bits is provided. The method may handle the potentially harmful drill bits and their potential additional coupling parts without the need for manual work which in turn provides an increased safety and personal safety at a drilling site where said method if performed. As should be realized, the method as presented herein may provide additional benefits coupled to the various optional features of the drill bit change system according to the disclosure.

According to an aspect, the method may further comprise a step g) aligning the splines of the splines coupling, said step g) being performed between steps d) and e).

This has the advantage that the method is provided with a means of automatically detect and adjust for a potential misalignment of the splines of the splines coupling. This is very beneficial as splines may be difficult to handle automatically for these types of operations, and/or potentially be dangerous to perform manually.

According to an aspect, step g) may comprise the sub-steps of: g-1) monitoring a feed pressure by means of a pressure sensor to detect a pressure build-up if the splines engage each other due to misalignment, g-2) stopping movement of the drill pipe if pressure build-up is detected, g-3) rotating the drill pipe slowly until the splines align.

This has the advantage that the method is provided with a means of automatically detect and adjust for a potential misalignment of the splines of the splines coupling, wherein the disclosed sub-steps provide a fast, easy and reliable manner to align the splines.

According to an aspect, the breaking operation of step a) may be performed by performing a plurality of break cycles to loosen the threaded coupling, wherein a break cycle may be a torque provided to the threaded coupling, in a rotational direction opposite to a pitch direction of the threads of said threaded coupling.

This has the advantage that the break operation may be performed in a more controlled and reliable manner. The threaded connections of a drilling rig may often be tightly coupled as the thread pitch is arranged to conform to the operational rotation of the drill pipes and drill bits. Thus, by means of performing a break operation in the form of a plurality of break cycles, such a threaded coupling is less likely to be stuck in place. This in turn provides a more reliable method as it is more likely to be able to perform the next step of the method without problems.

According to an aspect, software is provided, which software when stored in a control unit of a system for at least semi-automatic changing of drill bits in a drilling rig and is executed performs the method according to the disclosure.

This has the advantage that the method may be comprised in pre-programmed software, which may be implemented into any drilling rig suitable for utilizing such a method.

Additional objectives, advantages and novel features of the invention will be apparent to one skilled in the art from the following details, and through exercising the invention. While the invention is described herein, it should be apparent that the invention may be not limited to the specifically described details. One skilled in the art, having access to the teachings herein, will recognize additional applications, modifications and incorporations in other areas, which are within the scope of the invention.

BRIEF DESCRIPTION OF THE DRAWINGS

Below is a description of, as examples, embodiments with reference to the enclosed drawings, in which.

DETAILED DESCRIPTION

The detailed description with reference to the embodiments depicted are to be viewed as exemplary embodiments comprising a combination of certain features, which features have been described in detail above. It is thus to be understood that additional embodiments may be achieved by combining other features into embodiments not depicted herein. The figures are to be viewed as examples and not mutually exclusive combinations. It should also be noted that all figures shown and described are schematically represented, wherein generic parts of machinery or similar is not depicted for the sake of simplicity.

Figure 1:
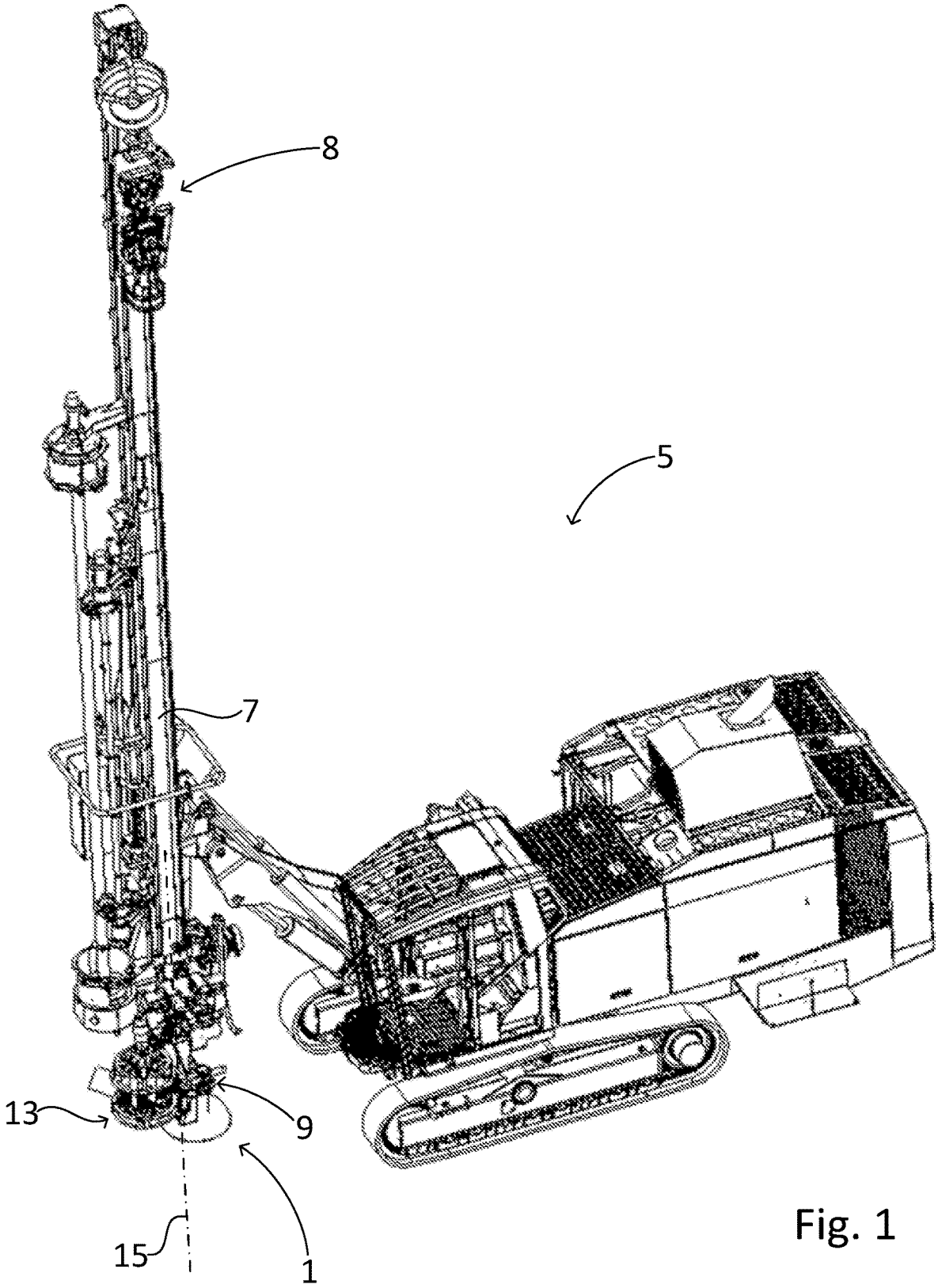
FIG. 1 shows a drilling rig in a perspective view according to an embodiment.

FIG. 1 shows a drilling rig 5 in a perspective view according to an embodiment. The drilling rig 5 is configured for vertical drilling, which is to be perceived as completely vertical or deviating from vertical to some extent. The drilling rig 5 may thus be able to be tilted and drill at an angled direction, in the range of about 0° to about 35° relative a vertical line without deviating from the scope of the disclosure. The drilling rig 5 may comprise an interchangeable plurality of drill pipes 7, arranged to form a drill line within a drill tower 8 of the drilling rig 5. Each drill pipe 7 comprises threads providing the option of connecting additional drill pipes 7 as a hole being drilled gets deeper. A drill bit 3 is then arranged at an end section of an end drill pipe 7, wherein said drill bit 3 may be attached to the end section by means of said threaded connection thereof. The manner in which such a connection is established between a drill pipe 7 and a drill bit 3 may vary depending on the type of drilling being performed, and thus also depend on the type of drilling rig 5 being used. This will be explained in more detail later in the description, with reference to FIG. 4.

The drilling rig 5 shown in FIG. 1 is to be perceived as a DTH/ITH (down the hole/in the hole)-drilling rig or a Coprod™-drilling rig. Both named types of drilling rigs 5 share the feature of providing torque to the drill bit 3 by means of a splines coupling. It should be noted that the term "drill bit" herein may refer to a drill bit comprising additional parts for coupling operation. Thus, the term drill 3 bit may be a single drill bit or a drill package comprising a drill bit and additional parts such as sleeves, retainer rings or other.

The drilling rig 5 may further comprise a lower support device 9, which may be arranged at a lower portion of the drilling rig 5 and being arranged for supporting and/or holding/gripping a drill bit 3 or a drill pipe 7, which may be utilized for maintenance and/or assembly/disassembly or such parts. In general, such a lower support device 9 may often be called a lower steel support for certain types of drilling rigs 5. The drilling rig 5 may even further comprise a breaker device 11, configured for loosening threaded connections of the drill pipes 7 during disassembly of the drill line. The breaker device 11 will be described in more detail with reference to FIG. 2.

The drilling rig 5 shown in FIG. 1 may further comprise a system 1 for at least semi-automatic changing of drill bits 3. Said system 1 is arranged close to ground level and being arranged parallel with the drill centre 15 of the drilling rig 5. The term drill centre 15 may be perceived as a centre line in a hole being drilled by means of the drilling rig 5. The drill bit change system 1 is thus arranged so as to follow the alignment of the drill centre 15 when being used. If the drill tower 8 is being tilted to an angle, the drill bit change system 1 and its ingoing parts may this also be tilted along with the drill centre 15 and the drill tower 8.

Figure 2:
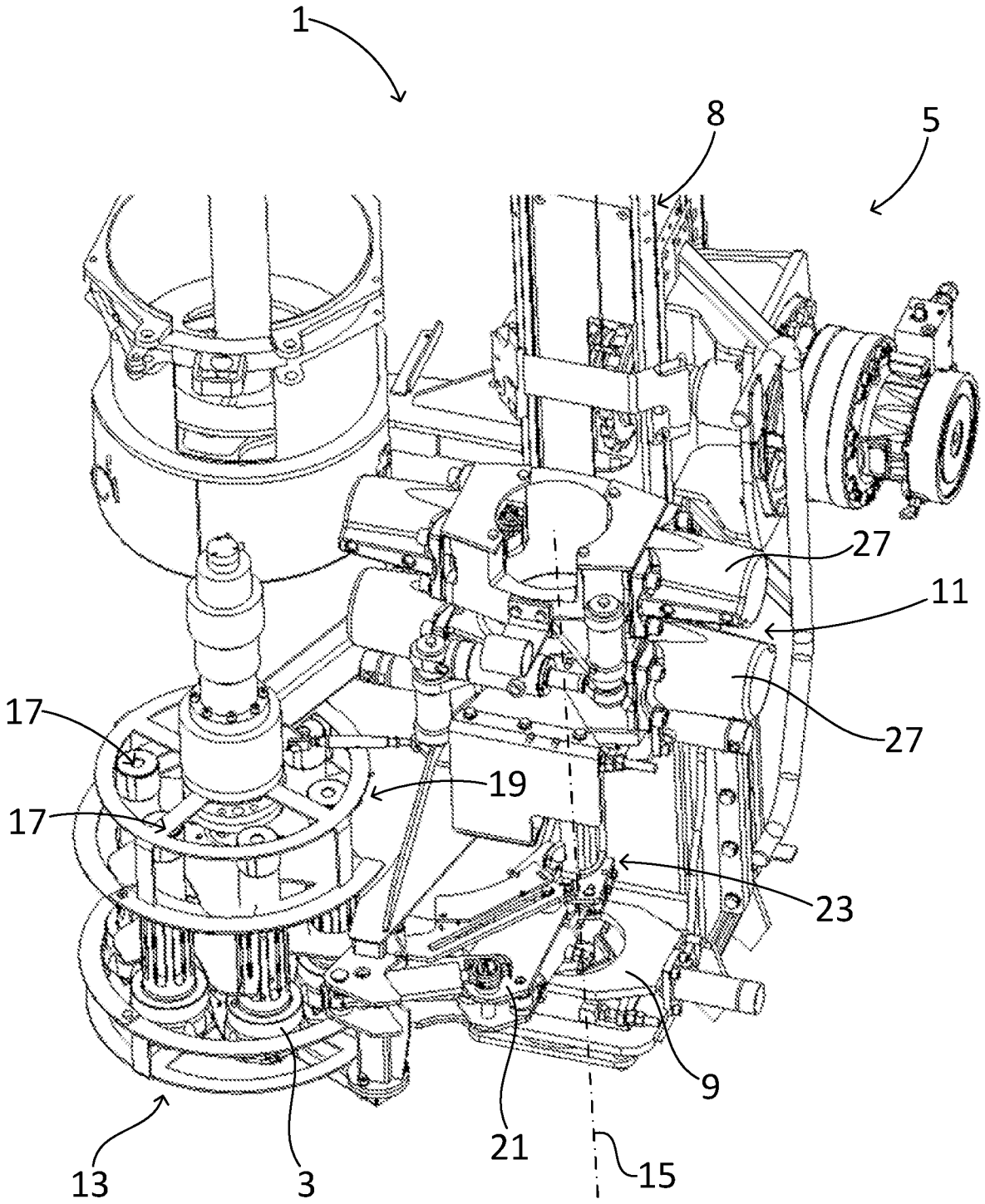
FIG. 2 shows a drill bit change system in a perspective view according to an embodiment.

FIG. 2 shows a drill bit change system 1 in a perspective view according to an embodiment, wherein parts of a drilling rig 5 to which the system is arranged is also shown in the figure. The drilling rig 5 may be a drilling rig 5 as shown in FIG. 1 or similar, wherein the drilling rig 5 may be configured for vertical drilling. The drilling rig 5 may comprise an interchangeable plurality of drill pipes (not shown), wherein drill bits 3 are arranged at an end section of an end drill pipe, the drill bit 3 being attached to the end section by means of a threaded connection and torque being provided to the drill bit by means of a splines coupling. The drilling rig 5 may further comprise a lower support device 9 and a breaker device 11, configured for loosening threaded connections of the drill pipes. The breaker device 11 of the drilling rig 5 may, as depicted in FIG. 2, comprise two hydraulically controlled gripping devices 27, arranged circumferentially around, and at separate positions along, the drill centre 15. The two gripping devices 27 may be arranged to grip a part of the drilling rig 5 and being hydraulically coupled so as to be radially displaceable relative each other, wherein the two gripping devices 27 may grip and rotate two separate parts of the drilling rig relative each other so as to open a threaded coupling arranged between said two part. As should be obvious, two drill pipes being coupled to each other by means of a threaded connection there between may thus be gripped by one gripping device 27 each, wherein the threaded connection is positioned laterally between the two gripping devices 27. The two gripping devices 27 may, as mentioned above, be hydraulically coupled to each other. A hydraulic cylinder 29 may thus be arranged between the two, wherein a displacement of a piston of said cylinder 29 will force the two gripping devices 27 to be radially displaced relative each other. This may be achieved in a plurality of ways, such as both gripping devices 27 rotating in opposite directions, one of the gripping devices 27 rotating relative the other, or the other rotating relative the first gripping device 27. For the example as depicted in FIG. 2, it may be preferred to arrange the lower of the two gripping devices 27 as fixated relative the drill tower 8 (only seen in part), and arranging the upper drilling device 27 to be rotationally moveable relative the lower gripping device 27 and the drill tower 8. By means of having the lower gripping device 27 in a fix position, a drill bit 3 or part thereof will not be rotated when breaking a threaded connection of drill pipes or a threaded connection of a drill pipe and said drill bit 3.

The system 1 may comprise a drill bit storage device 13, arranged adjacent and parallel with the drill centre 15 of the drilling rig 5 and being arranged to hold a plurality of drill bits 3 and to move drill bits 3 between storage positions 17 and an exchange position 19 comprised therein. The drill bit storage device 13 may, as depicted in FIG. 2, have a cylindrical drum shape, wherein the movement between internal positions 17, 19 within the drill bit storage device 13 may be performed by rotation of such a cylindrical storage device 13, or by means of a rotation of internal parts thereof. The drill bit storage device 13 may of course have other designs without deviating from the scope of the disclosure herein. Each storage position 17 may hold one drill bit 3, which may be a ready to use drill bit 3 or a drill bit 3 used in a previous drilling operation. The exchange position 19 may be the single position within the storage device 13 from which a drill bit 3 may be retrieved or positioned, wherein the internal movement of the storage device 13 may be used to position a desired slot for holding a specific drill bit 3 at the exchange position 19. The drill bit change system 1 may further comprise a gripping arm 21 comprising gripping means 23 configured for selective gripping of a drill bit 3, the gripping arm 21 being arranged to move the gripping means 23 between the exchange position 19 and the drill centre 15 of the drilling rig 5. As is shown in FIG. 2, the gripping arm 21 and the gripping means 23 may be hydraulically controlled, wherein movement and gripping of the two may be exerted with high precision and apply large forces to said functions. Furthermore, as the gripping arm 21 only needs to move to a single position 19 within the drill bit storage device 13, the movement of the gripping arm 21 may be performed by means of a pivoting motion which reduces the complexity of the gripping arm 21 and its design.

The gripping means 23 may further comprise a pressure sensor (not shown), arranged to monitor an operational state of the gripping means 23 and an applied pressure towards a drill bit 3. Such a pressure sensor may easily be arranged within the hydraulics of the gripping means 23, as the internal pressure of the hydraulic cylinders controlling the gripping movement of the gripping means 23 directly correlates to when the gripping means 23 engages an object. The pressure sensor may thus be utilized to ensure that the gripping means 23 always provides the same amount of gripping force to an object (such as a drill bit) regardless of the size of said object.

The gripping arm 21 may further comprise a movement sensor (also not shown), arranged to monitor movement of the gripping arm 21. Such a sensor may, similar to the sensor for the gripping means 23, be a pressure sensor arranged within hydraulics for controlling the gripping arm 21. Other types of sensors may of course also be used, such as IR-sensors or similar, without deviating from the scope of the disclosure. By means of monitoring the movement of the gripping arm 21, it should be noted that such a monitoring may also be utilized to obtain positional information relating to the position of the gripping arm 21 and thus also the gripping means 23 at any given point in time. Herein the movement sensor may be perceived as such a pressure sensor arranged in the hydraulics though, wherein movement of the gripping arm 21 is monitored by means of monitoring the internal pressure within said hydraulics. Thereby movement and positioning of the gripping arm 21, and deviations thereof, may be monitored with high accuracy and reliability. If for example the gripping arm 21 is to move a drill bit 3 from the drill centre 15 and the drill bit 3 for some reason gets stuck in its intended path, the internal pressure of the hydraulics will increase at a non-expected point in time and the pressure sensor may alarm the system 1 of an unexpected occurrence.

The system 1 may further comprise a control unit, arranged to receive input from the sensors and the drilling rig 5, and to control movement of the gripping arm 21, the gripping means 23, the drill bit storage device 13, and the breaker device 11 of the drilling rig 5. The control unit is not depicted in FIG. 2, but may be arranged within the system 1, or at a remote location such as within an operator cabin of the drilling rig 5 for example. The control unit may be coupled to the sensors, the system 1 and the drilling rig 5 by means of wires or by means of a wireless interface according to known art.

By means of connecting the control unit not only to the drill bit change system 1 and its parts but also to the drilling rig 5 and its parts, the control unit may be able to allow the rig 5 and the system 1 to interact and cooperate, which provides more efficient operations performed by the system 1. Furthermore, as the control unit may take control over and control machinery such as the breaker device 11 of the drilling rig 5, lesser complex machinery is needed for the system 1 itself, which lowers manufacturing costs for the system 1.

The drill bit storage device 13 may further comprise at least one drill bit sensor (not shown), arranged to monitor drill bits located in the positions 17, 19 of the drill bit storage device 13.

Such an at least one sensor may be an optical sensor or a pressure sensor or similar, arranged to monitor if a drill bit 3 is positioned in a specific position 17, 19, or a plurality of positions 17, 19 if arranging a plurality of such sensors. Such a sensor may also be a more complex sensor device, arranged not only for monitoring positioning within the storage device 13, but also to analyse and evaluate drill bits 3 positioned in the storage device 13. Such a sensor device may scan the surface of a drill bit 3 and compare it to a predetermined surface of a well-functioning drill bit 3, wherein the control unit may provide an operator of the drilling rig 5 with information regarding the state of the drill bits 3 positioned in the storage device 13. Thereby faulty drill bits 3 may be discovered and replaced for a higher operational uptime of such a drilling rig 5.

The control unit may be configured to initiate the at least semi-automatic changing of drill bits 3 based on operational data of the drilling rig 5 and the drill bit 3 connected to the drilling rig 5. Such operational data may be data comprising any one or a combination of: time spent drilling, time spent drilling since last maintenance, expected time left until change is needed, meters drilled, meters drilled since last maintenance, or other. Such operational data may relate to the drilling rig 5, each drill bit 3 arranged in the drill bit change system 1, or both. By means of taking such operational data into consideration, and by having a drilling scheme available, the control unit may thus automatically initiate a drill bit changing operation in-between drilling of holes, if it is determined that the current drill bit 3 will not be operational for the entirety of the next hole to be drilled. Thereby a lot of wasted time may be cut from a drilling scheme comprising a plurality of holes, as inspection of the drill bits 3 is not needed in-between holes to be drilled.

The control unit may further be arranged to determine an operational condition of a drill bit 3 based on its operational data, and to provide an interface with a signal when drill bit change is needed. If certain operational data is known beforehand, such as previous time spent drilling, in what type of material etc. for a specific drill bit 3, and said drill bit 3 is used for drilling a hole, the control unit may then monitor and update such operational data so as to provide and update an operational condition for said drill bit 3. If for example a drill bit 3 is estimated to be able to drill for a certain amount of time in a certain type of material, the control unit may add operational time for said drill bit 3 and monitor its usage over time. Such data may then be stored in a memory and kept track of for each specific drill bit 3 in a system 1, wherein the drill bits 3 positioned in the storage positions 17 of the drill bit storage device 13 may be monitored with regards to their individual operational conditions. Such information may then be sent to a user interface or similar so as to display the operational conditions for all drill bits 3 available, wherein an operator of a drilling rig 5 may use said information to better plan future drilling operations. The control unit may also plan the drilling operations in combination with a provided drilling scheme, wherein a suitable drill bit 3 is moved to the exchange position 19 when a hole, for which the operational condition of said drill bit 3 is deemed suitable, is to be drilled. By means of allowing the control unit to plan drilling operations in such a manner, and to automatically initiate drill bit changing operations, a lot of time may be saved, and the drill bits 3 may be used to the their combined maximum capacity.

Figure 3:
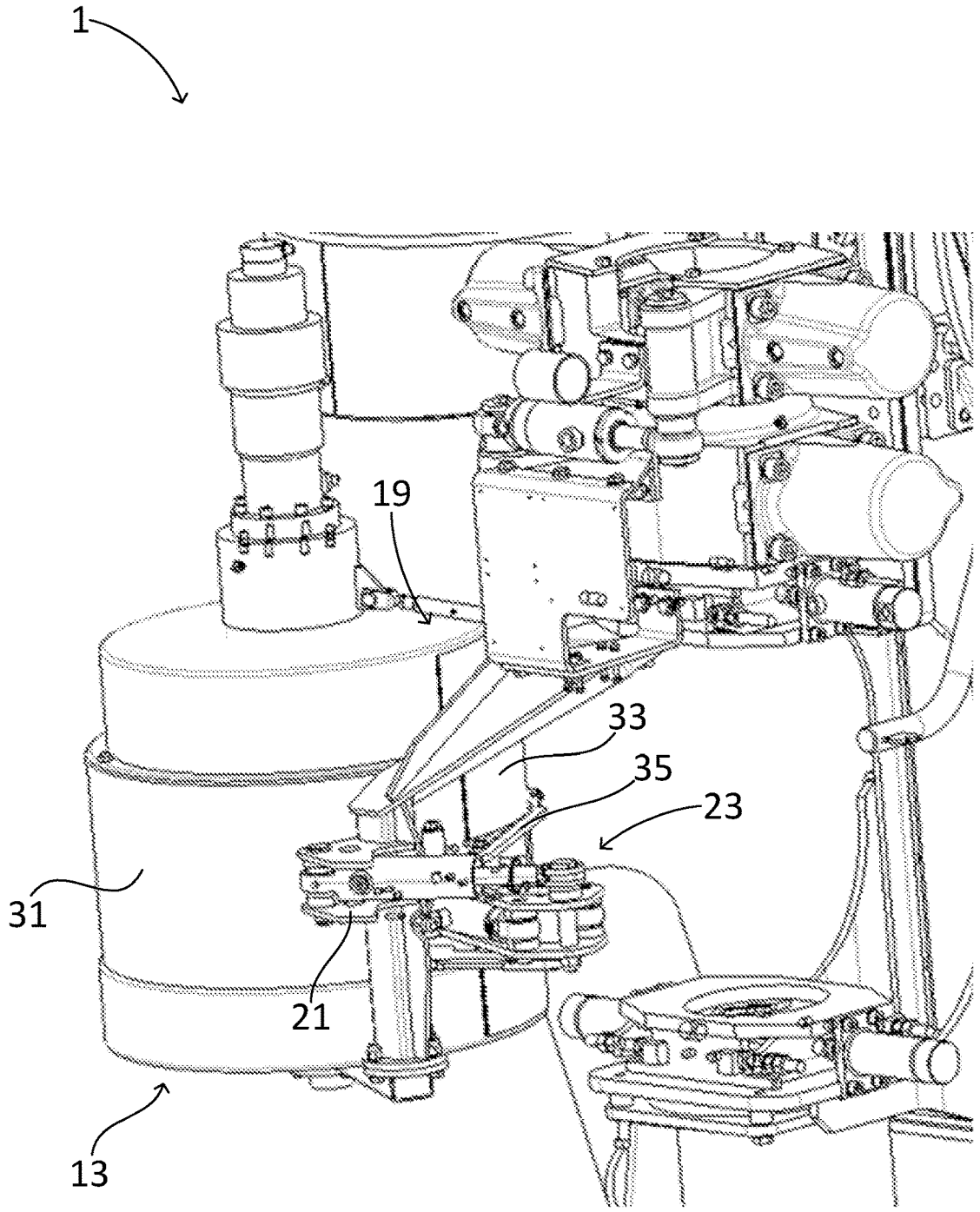
FIG. 3 shows a drill bit change system comprising a covered drill bit storage device according to an embodiment.

FIG. 3 shows a drill bit change system 1 comprising a covered drill bit storage device 13 according to an embodiment. The drill bit storage device 13 may thus further comprise an enclosing protective housing 31, wherein said housing 31 may comprise at least a first door 33 arranged at the exchange position 19 thereof. The first door 33 may be arranged to be selectively opened and closed depending on a drill bit exchange operation being performed. Such a protective housing 31 may be in the form of a metal casing, a polymeric cover or other, enclosing the brill bit storage device 13 with enough clearance with regards to the drill bits positioned therein so that movement between the internal positions may be performed without issues. The protective housing 31 may be arranged to the drill bit storage device 13 by means of easy to use fastening elements, so as to be able to remove the housing 31 in its entirety when re-filling or replacing drill bits in the storage device 13. The drill bit storage device 13 may also further comprise a second door (not shown in FIG. 3), arranged at a position separated from the first door 33. Thus re-filling or replacing drill bits in the storage device 13 may be performed by means of said second door. The first door 33 may be used to provide access to the exchange position 19 for the gripping arm 21 and the gripping means 23, for retrieving and placing operations of a drill bit therefrom or thereto. The first door 33 of the protective housing 31 may be coupled to the gripping arm 21, wherein the first door 33 automatically opens and closes depending on the movement of the gripping arm 21. As the gripping arm 21, as depicted in FIG. 2, may be arranged so as to move between its end positions by means of a lateral pivoting movement, the gripping arm 21 may easily be connected to said first door 33 by means of an interconnecting link arm arrangement 35 or similar. Thereby a purely mechanical solution may be provided, which automatically will open and close the first door 33 according to the operation of the gripping arm 21. It is of course desirable to keep the first door 33 closed except for when the gripping means 23 needs to reach a drill bit and/or the exchange position 19, wherein the first door 33 and/or a doorframe for the first door 33 may be provided with a sealing material at a circumference thereof, so as to provide an as tight seal of the first door 33 relative the protective housing 31 as possible. Thereby the protective housing 31 may protect the drill bits within the drill bit storage device 13 from the, in general, unclean environment surrounding a drilling rig. It is of course also possible to provide the first door 33 with actuating means for opening and closing, wherein said actuating means may be controlled by the control unit in accordance with the movement of the gripping arm 21. Additional covering devices and alternative embodiments of the protective housing 31 disclosed herein may also be possible without deviating from the scope of protection. As an example, the exchange position 19 may be opted to not be covered, as a drill bit coming from a drilling operation and is to be placed therein will most likely not be clean regardless. It may thus be an option to modify the protective housing 31 taking this into consideration. It is also possible to provide individual protective devices for each drill bit positioned within the drill bit storage device 13, or to use a combination of such individual protective devices and the protective housing 31 as disclosed herein.

Figure 4:
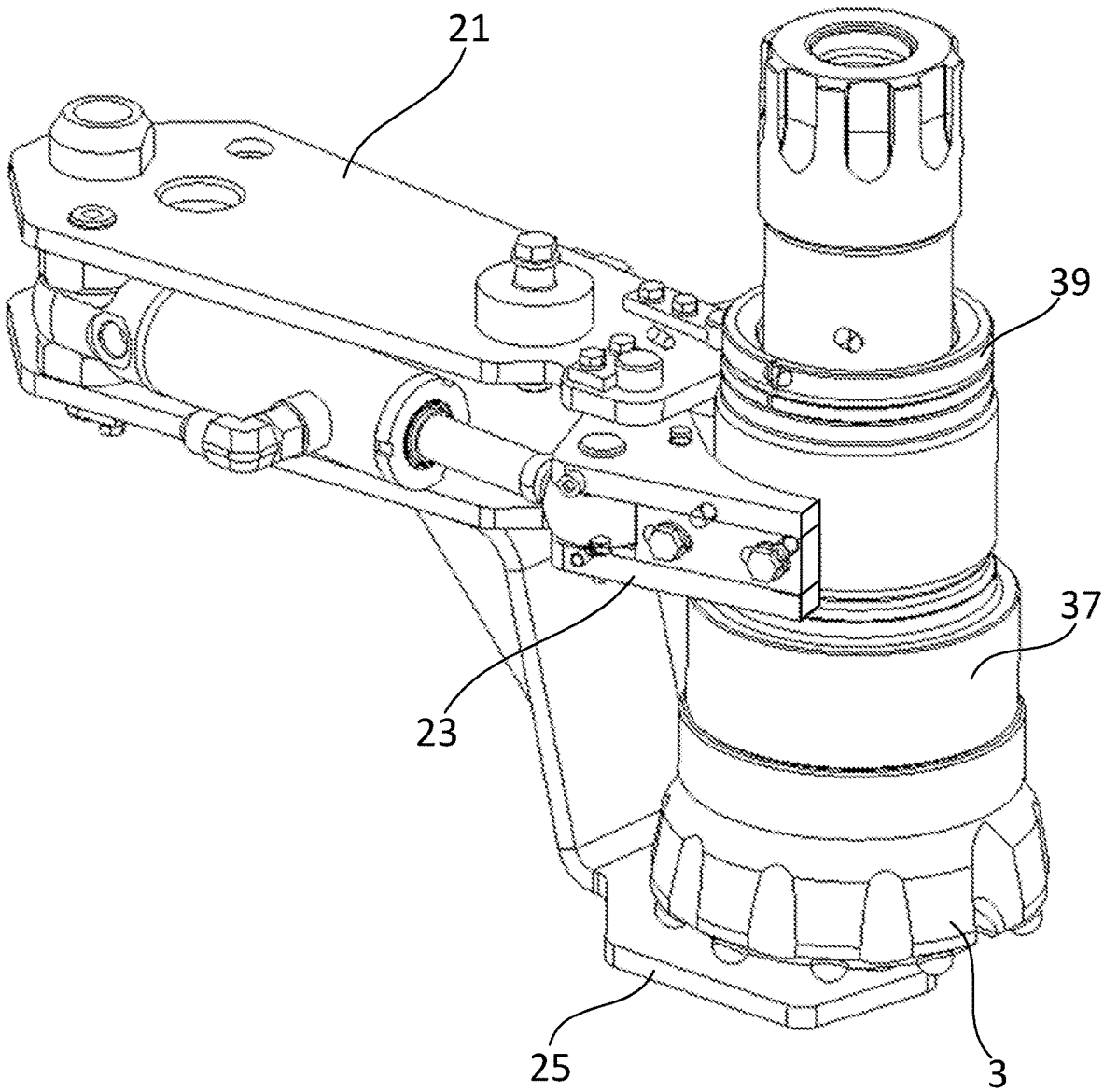
FIG. 4 shows a gripping arm of a drill bit change system according to an embodiment.

FIG. 4 shows a gripping arm 21 of a drill bit change system 1 according to an embodiment. The gripping arm 21 may, as depicted in FIG. 4, further comprise a lower support plate 25, which is arranged below the gripping means 23 and being arranged to be movable in accordance with the gripping means 23 so as to support a drill bit 3 from underneath when held by said gripping means 23. Depending on if the drill bit change system 1 is to be used for a DTH/ITH-drilling rig, a Coprod™-drilling rig, or for both said types of drilling rigs, the lower support plate 25 may be arranged to the gripping arm 21 and gripping means 23 in varying manners. As will be understood, the lower support plate 25 is needed for DTH/ITH-drilling rigs, wherein the lower support plate 25 may be fixedly arranged to the gripping arm 21 if the drill bit change system 1 if to be used for a DTH/ITH-drilling rig only. If the drill bit change system 1 if to be used for a Coprod™-drilling rig only, the lower support plate 25 may be beneficial but may also be an optional feature. If the system 1 is desired to be used interchangeably between the two mentioned types of drilling rigs, the lower support plate 25 may be selectively attachable to the gripping arm 21. Furthermore, the lower support plate 25 may be movably arranged, wherein an input to the control unit may move the lower support plate 25 to and away from the gripping arm 21 as well, by means of an actuator means arranged between the gripping arm 21 and the lower support plate 25.

The reason the lower support plate 25 is needed for handling of DTH/ITH-drilling rigs is due to how the drill bits 3 (or drill bit packages) are configured for such a drilling rig. As seen in FIG. 4, the gripping means 23 is gripping a sleeve member 37 arranged at a circumference of the actual drill bit. Said sleeve member is generally called a bit chuck, and the bit chuck comprises splines arranged at an inner circumference, which splines are arranged for providing torque to the drill bit 3. Above the sleeve member 37, a pair of retainer rings 39 are arranged, which retainer rings 39 are arranged to hold the drill bit package in place when the drill bit package is connected to a drill hammer and drill pipes so as to provide a DTH/ITH-drill line. It should be noted that a general knowledge of these mentioned and commonly used types of drilling rigs is expected of the reader of this disclosure. As should be obvious, the bit chuck and the drill bit 3 being coupled to each other by means of a splines coupling only, the lower support place 25 is thus needed to support the drill bit 3 when the gripping means 23 grips the sleeve member 37 as shown in FIG. 4. The lower support plate 25 will thus allow for handling of entire drill bit packages in the same manner as individual drill bits 3 within the system 1. When the drill bit change system 1 is used for a Coprod™-drilling rig, the lower support plate 25 may not be needed as a Coprod™-drill bit does not comprise a bit chuck as a DTH/ITH drill bit needs to comprise. Instead a Coprod™-drill bit is coupled to an end of a drill pipe by means of an intermediate Coprod™—head piece, which head piece may be threaded to a drill pipe and hold the Coprod™-drill bit in place by means of Coprod™-retainer rings. Such a Coprod™-head piece may be loosely threaded to an end drill pipe when performing a drill bit change operation. So for such cases, the gripping means 23 grips the drill bit directly without the risk of any additional non-coupled connection parts thereto falling off the drill bit.

Figure 5:
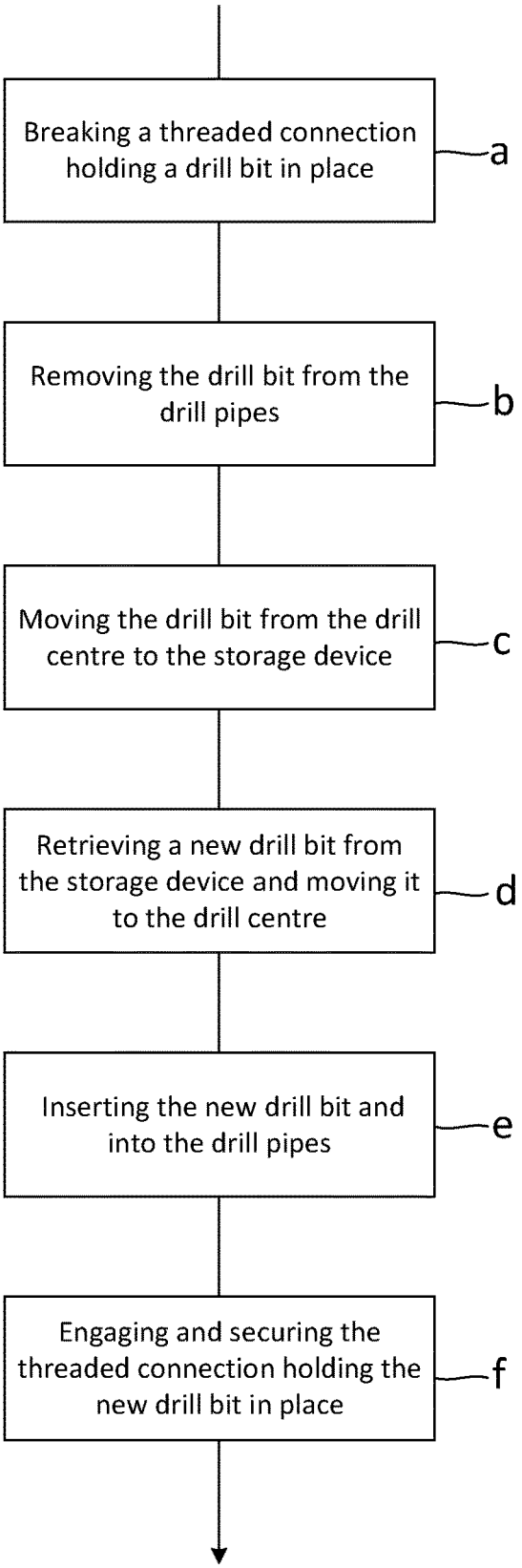
FIG. 5 shows a flowchart of a method according to an embodiment.

FIG. 5 shows a flowchart of a method according to an embodiment. The method as depicted by the flowchart is a method for changing a drill bit in a drilling rig configured for vertical drilling.

The drilling rig comprising an interchangeable plurality of drill pipes, wherein drill bits are arranged at an end section of an end drill pipe. The drill bit being attached to the end section by means of a threaded connection, and torque being provided to the drill bit by means of a splines coupling. The drilling rig further comprises a lower support device and a breaker device, the breaker device being configured for loosening threaded connections of the drill pipes. Here it should be noted that the phrasing "loosening threaded connections" refer to loosing but not completely un-thread said connection. When a threaded connection has been "loosened" as the phrase is to be viewed herein, the threads are to be perceived as still engaged with each other but not in a fixated manner. A "loosened" threaded connection may thereafter be opened in its entirety by means of a rotating provided to the connection in any suitable manner, such as a slow rotation of the drill line for example. A system for at least semi-automatic changing of drill bits according to the disclosure is further arranged to the drilling rig, said system being arranged to perform the method disclosed herein. The method may comprise the steps of: a) breaking the threaded connection holding the drill bit coupled to an end drill pipe by means of the breaker device, b) removing the drill bit from the drill pipe by means of the lower support device, c) moving the drill bit from the drill centre to the drill bit storage device by means of the gripping arm, d) retrieving a new drill bit from the drill bit storage device and moving it to the drill centre, e) inserting the new drill bit into the drill pipe, and f) engaging and securing the threaded connection holding the new drill bit coupled to the end drill pipe.

In more detail the method being carried out may be described as follows. When drilling has stopped and a drill bit change operation is initiated, the drill bit which is to be replaced is moved up from the drilled hole, drill pipes being removed when suitable during such a lifting procedure. The drill bit is then lifted vertically so that the threaded connection holding it in place gets positioned at the correct position within the breaker device. The drill bit is engaged by, and held by, the lower support device of the drilling rig. A break operation is performed by the breaker device to the threaded connection, so as to loosen said threaded connection and thus freeing the drill bit from the rest of the drill line. The drill bit is lowered to an exchange position, in which position the drill bit is reachable by the gripping arm and the gripping means of the drill bit change system. The gripping arm moves the gripping means towards the drill bit, wherein the gripping means grips the drill bit. The gripping arm then moves the gripping means, holding the drill bit, towards the exchange position of the drill bit storage device. The gripping means lets go of the drill bit so as to allowing the drill bit to be positioned within the drill bit storage device, wherein the drill bit storage device re-arrange the drill bits therein so as to move the old drill bit to a storing position and a new drill bit to the exchange position. The gripping means of the gripping arm may then grip the new drill bit and move it back to the drill centre of the drilling rig. The new drill bit and the end drill pipe are moved closer together, either by moving the drill bit upwards by means of the lower support device, or by moving the end drill pipe downwards by means of a feeding device of the drilling rig. The drill bit is thus then inserted into the end drill pipe. The threaded connection arranged to hold the drill bit connected to the drill line is then engaged and secured by means of a relative rotation of the drill bit and at least part of said drill line. The gripping arm is lastly moved away from the new connected drill bit, wherein a new drilling operation may be commenced using the new attached drill bit.

The break operation as disclosed in step a), and further described above may be performed by a plurality of break cycles to loosen the threaded coupling. Such a break cycle may be an impulse of torque applied to the threaded coupling in a rotational direction opposite to a pitch direction of the threads of the threaded coupling. As the rotational direction of the drill pipes when drilling is conformed to the thread pitch of the threaded couplings of the drill line, so as not to loosen such threaded connections by means of regular drilling being performed, the threads may be very tightly secured to each other after drilling has ceased. Thereby a plurality of break cycles may alleviate such threaded connections to remain threaded stuck to each other. The control unit of the drill bit change system may be configured to perform a predetermined number of break cycles, deemed as a suitable number to loosen the threaded coupling. The control unit may also be configured for performing a break cycle and then a following attempt at moving the drill bit away from the drill line, wherein if such movement is not possible, it is interrupted and another break cycle is initiated. By means of utilizing pressure sensors within hydraulics arranged to perform such movement, an unsuccessful break cycle is quickly detected due to a fast increase in internal pressure within said hydraulics.

The method may further comprise an additional step g) aligning the splines of the splines coupling, said step g) being performed between steps d) and e). By means of this feature being comprised in the method, said method may thus be able to handle a drilling rig using drill bit and drill packages having more complex designs and arrangements, as both splines and threads may be handled within the same method. Aligning the splines may be performed in different manners, wherein one example is presented in more detail with reference to FIG. 6.

Figure 6:
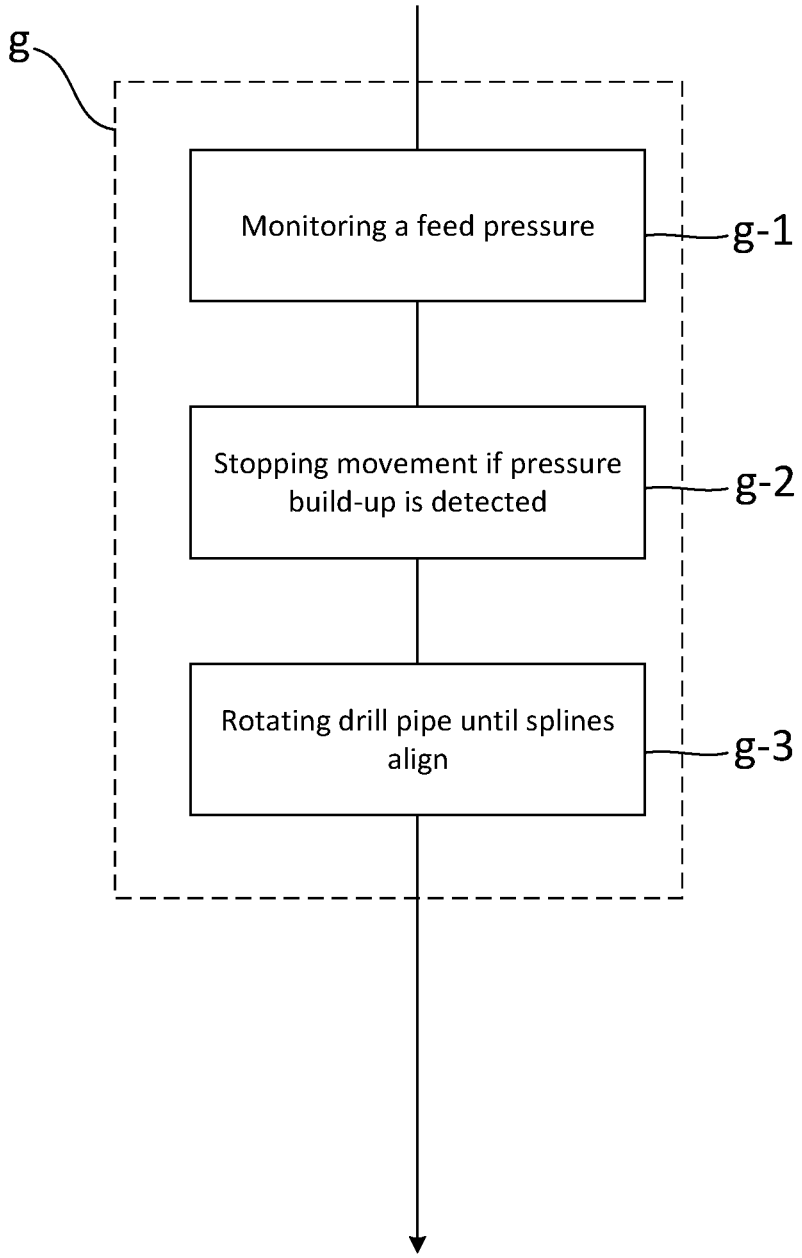
FIG. 6 shows a flowchart of parts of a method according to an embodiment.

FIG. 6 shows a flowchart of parts of a method according to an embodiment. The method disclosed herein may be perceived as a sub-method further defining step g) of the method described above. According to this embodiment of the method, step g) may comprise the sub-steps of: g-1) monitoring a feed pressure by means of a pressure sensor to detect a pressure build-up if the splines engage each other due to misalignment, g-2) stopping movement of the drill pipe if pressure build-up is detected, and g-3) rotating the drill pipe slowly until the splines align, wherein the new drill bit may be fully inserted into the drill pipe or similar element being arranged at the end of the drill line. This may thus describe in more detail how the splines of the splines coupling may be aligned in an automatic manner. As both ingoing parts of a splines coupling comprises splines which may be perceived as ridges to be inserted into opposite recesses between said ridges, there is always a risk of ridges engaging ridges when initiating an engagement of such a coupling. If the drill bit is perceived as held in a fix position and the end drill pipe or another part comprising the opposite splines that is to engage said drill bit is moved towards said drill bit, two things may occur. If the splines are aligned correctly the will just slide past each other and no problems occur. If the splines, or ridges, engage each other instead, the drill pipe of the downwards moving drill line will be hindered from further movement. This will result in a pressure build-up for the downwards feeding of said drill pipe, which by means of the control unit may be detected to arise before the drill pipe has reached a vertical position in which the connection of the drill bit to the drill line is completed. When such a pressure build-up is detected, the control unit may thus stop the downwards movement, and instead initiate a slow rotation of the drill pipe, which rotation eventually will result in the splines interconnecting in a proper alignment. When proper alignment occurs, the pressure build-up will thus be alleviated as short ends of the splines, or ridges, are no longer in contact with each other which causes said pressure build-up within the feeding of the drill pipe. When the pressure build-up is gone, the control unit may thus detect this, and continue a downwards movement of the drill pipe to a position in which the threaded connection may be engaged and secured. By means of utilizing this method, no manual labour is thus needed as the method may be performed automatically. This in turn provides a safer work environment surrounding a drilling rig comprising this type of drill bit change system and performing the method described herein.

There are however alternative solutions to aligning the splines of the spline coupling. Another alternative solution will also be briefly explained herein. The feed pipe may be slowly moved towards the drill bit or drill bit package, so as to attempt to insert the drill bit into its receiving counterpart of the drilling rig. If the splines are misaligned, engage each other by means of their respective short ends of the splines, a pressure build-up will arise and be detected as previously described. However, instead of holding the feed constant and slowly rotating the drill line so as to align the splines, the feed motion may instead be reversed a predetermined distance, so the pressure build-up is alleviated wherein it may be deduced that the splines of the splines coupling is no longer in contact. The drill line is then rotated with a predetermined angular displacement, or rotated a predetermined amount of time, or other. After this short rotation the control unit will attempt another downwards feed with the newly established angular positioning of the splines. If the splines now are aligned, the method may carry on as intended. If the splines are still not aligned however, the process may be repeated to achieve another angular positioning of the splines. In other words, the step of aligning the splines of the splines coupling may be performed as an iterative process, which is very reliable in that it may be performed as a loop that will be executed until no pressure build-up is detected and it is deductively ensured that the splines then are correctly aligned.

The method, in any of its described embodiment may further be stored in the control unit, wherein the software when executed may perform the at least semi-automatic method of changing of drill bits in a drilling rig comprising such a control unit.

The foregoing description of the embodiments has been furnished for illustrative and descriptive purposes. It is not intended to be exhaustive, or to limit the embodiments to the variations described. Many modifications and variations will obviously be apparent to one skilled in the art. The embodiments have been chosen and described in order to best explicate principles and practical applications, and to thereby enable one skilled in the arts to understand the invention in terms of its various embodiments and with the various modifications that are applicable to its intended use. The components and features specified above may, within the framework of the disclosure, be combined between different embodiments specified.

The invention claimed is:

1. A drill bit change system for at least semi-automatic changing of drill bits in a drilling rig configured for vertical drilling, the drilling rig comprising an interchangeable plurality of drill pipes, wherein drill bits are arranged at an end section of an end drill pipe, the drill hit being attached to the end section by means of a threaded connection and torque being provided to the drill hit by means of a splines coupling, the drilling rig further comprising a lower support device, arranged for supporting and/or holding/gripping a drill bit or a drill pipe, and a breaker device, configured for loosening threaded connections of the drill pipes, the system comprising a drill bit storage device, arranged adjacent and parallel with a drill center of the drilling rig and being arranged to hold a plurality of drill bits and to move drill bits between storage positions and an exchange position comprised therein, the storage positions being arranged for storing drill bits and the exchange position being arranged for moving drill bits to and from the drill bit storage device, a gripping arm comprising gripping means configured for selective gripping of a drill hit, the gripping arm being arranged to move the gripping means between the exchange position and the drill center of the drilling rig, wherein the gripping arm further comprises a movement sensor, arranged to monitor movement of the gripping arm, and wherein the system further comprises a control unit, arranged to receive input from the sensors and the drilling rig, and to control movement of the gripping arm, the gripping means, the drill bit storage device, and the breaker device of the drilling rig.

2. The system according to claim 1, wherein the drill bit storage device further comprises at least one drill hit sensor, arranged to monitor drill bits located in the positions of the drill bit storage device.

3. The system according to claim 1, wherein the control unit is configured to initiate the at least semi-automatic changing based on operational data of the drilling rig and the drill bit connected to the drilling rig.

4. The system according to claim 2, wherein the control unit is further arranged to determine an operational condition of a drill bit based on its operational data, and to provide an interface with a signal when drill bit change is needed.

5. The system according to claim 1, wherein the drill bit storage device comprises an enclosing protective housing, the housing comprising at least a first door arranged at the exchange position, the first door being arranged to be selectively opened and closed depending on a drill bit exchange operation being performed.

6. The system according to claim 5, wherein the first door of the housing is coupled to the gripping arm, wherein the first door automatically opens and closes depending on the movement of the gripping arm.

7. The system according to claim 1, further comprising a lower support plate, which is arranged below the gripping means and being arranged to be movable in accordance with the gripping means so as to support a drill bit from underneath when held by the gripping means.

8. The system according to claim 1, wherein the breaker device of the drilling rig comprises two hydraulically controlled gripping devices, arranged circumferentially around, and at separate positions along, the drill center, the two gripping devices being arranged to grip a part of the drilling rig and being hydraulically coupled so as to be radially displaceable relative each other, wherein the two gripping devices may grip and rotate two separate parts of the drilling rig relative each other so as to open a threaded coupling arranged between said two parts.

9. The system according to claim 1, wherein the drilling rig is a down-the-hole/in-the-hole drilling rig, and wherein the system further comprises a lower support plate, which is arranged below the gripping means and being arranged to be movable in accordance with the gripping means so as to support a drill bit from underneath when held by the gripping means.

10. A method for changing the drill bit of the drill bit change system for at least semi automatic changing of drill bits according to claim 1, the method comprising the steps of:

a) breaking the threaded connection holding the drill bit coupled to an end drill pipe by means of the breaker device, b) removing the drill bit from the drill pipe by means of the lower support device, c) moving the drill bit from the drill center to the drill bit storage device by means of the gripping arm, d) retrieving a new drill bit from the drill bit storage device and moving it to the drill center, e) inserting the new drill bit into the drill pipe, and f) engaging and securing the threaded connection holding the 1 bit coupled to the end drill pipe.

11. The method according to claim 10, further comprising a step g) aligning the splines of a splines coupling, said step g) being performed between steps d) and e).

12. The method according to claim 11, wherein step g) comprises the sub-steps of:

g-1) monitoring a feed pressure by means of a pressure sensor to detect a pressure build-up if the splines engage each other due to misalignment, g-2) stopping movement of the drill pipe if pressure build-up is detected, and g-3) rotating the drill pipe slowly until the splines align.

13. The method according to claim 10, wherein the breaking operation of step a) is performed by performing a plurality of break cycles to loosen the threaded coupling, wherein a break cycle is a torque provided to the threaded coupling, in a rotational direction opposite to a pitch direction of the threads of said threaded coupling.

14. A non-transitory, computer-readable media storing instructions that, when executed, performs the method according to claim 10.

* * * * *